US009482050B2

(12) United States Patent
Strand

(10) Patent No.: US 9,482,050 B2
(45) Date of Patent: Nov. 1, 2016

(54) SHADE LOCK ASSEMBLY

(71) Applicant: Hunter Douglas, Inc., Pearl River, NY (US)

(72) Inventor: Toralf Strand, Kittery Point, ME (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/585,349

(22) Filed: Dec. 30, 2014

(65) Prior Publication Data

US 2015/0184456 A1 Jul. 2, 2015

Related U.S. Application Data

(60) Provisional application No. 61/922,193, filed on Dec. 31, 2013.

(51) Int. Cl.
*E06B 9/42* (2006.01)
*E06B 9/78* (2006.01)
*E06B 9/50* (2006.01)

(52) U.S. Cl.
CPC . *E06B 9/42* (2013.01); *E06B 9/50* (2013.01); *E06B 9/78* (2013.01)

(58) Field of Classification Search
CPC ..... E06B 9/32; E06B 9/324; E06B 9/42; E06B 9/78; E06B 9/785
USPC ..... 160/178.2, 319
See application file for complete search history.

(56) References Cited

U.S. PATENT DOCUMENTS 4,352,386 A * 10/1982 Butler ..... E06B 9/324 160/178.2
4,646,808 A * 3/1987 Anderson ..... E06B 9/324 160/178.2
4,722,383 A * 2/1988 Kross ..... E06B 9/324 160/168.1 R
4,945,970 A * 8/1990 Marocco ..... E06B 9/305 160/178.2
7,775,254 B2 * 8/2010 Judkins ..... E06B 9/324 160/178.2
8,210,227 B2 * 7/2012 Hoffmann ..... E06B 9/324 160/178.2
2005/0056384 A1 * 3/2005 Dekker ..... E06B 9/324 160/178.2
2006/0118248 A1 * 6/2006 Anderson ..... E06B 9/262 160/84.04
2007/0044925 A1 * 3/2007 Huang ..... E06B 9/324 160/178.2
2008/0041535 A1 * 2/2008 Judkins ..... E06B 9/324 160/178.2
2010/0236731 A1 * 9/2010 Cheng ..... E06B 9/324 160/405
2011/0126994 A1 * 6/2011 Anderson ..... E06B 9/262 160/405
2013/0062022 A1 * 3/2013 Anderson ..... E06B 9/262 160/84.04
2014/0131502 A1 * 5/2014 Zhu ..... E06B 9/68 242/385.4

* cited by examiner

*Primary Examiner* — Katherine Mitchell
*Assistant Examiner* — Scott Denion
(74) *Attorney, Agent, or Firm* — Dority & Manning, P.A.

(57) ABSTRACT

A shade lock assembly for a shade assembly is provided. The shade lock assembly may include a spool rotatably attached to a housing, with the housing defining a pull cord channel. A pull cord may be provided that extends through the pull cord channel and wraps at least partially around the spool. The pull cord channel may include a roller wheel configured to interact with the pull cord and a second wall of the pull cord channel such that it may move between a locked and an unlocked position based at least in part by the angle at which the pull cord is held relative to a plane defined the shade assembly.

20 Claims, 8 Drawing Sheets

SECTION D–D

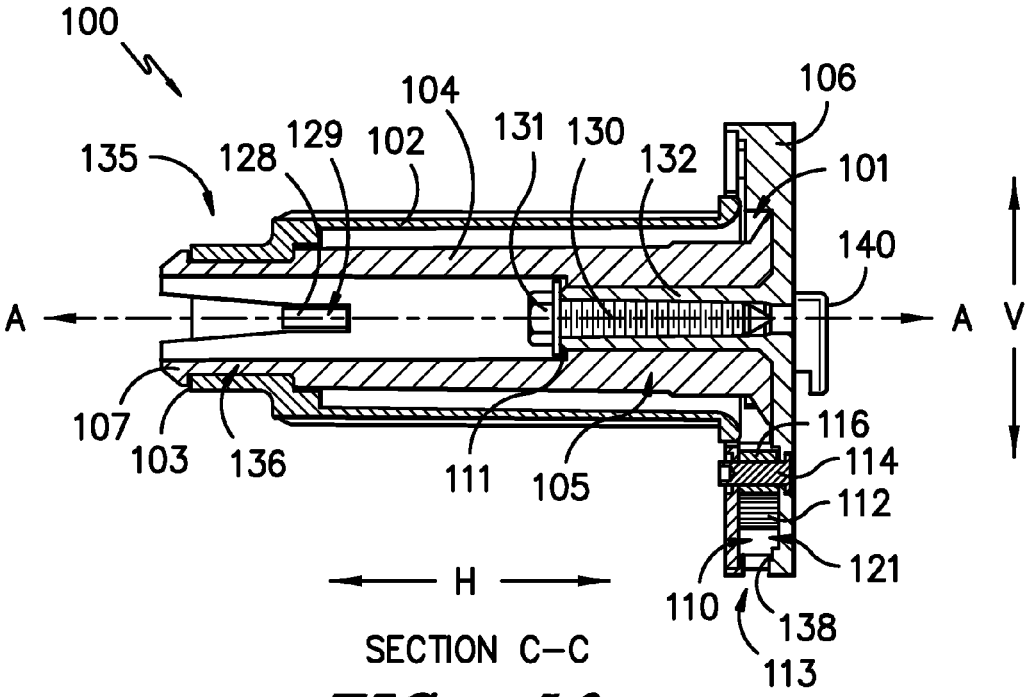
SECTION C–C
FIG. –10–
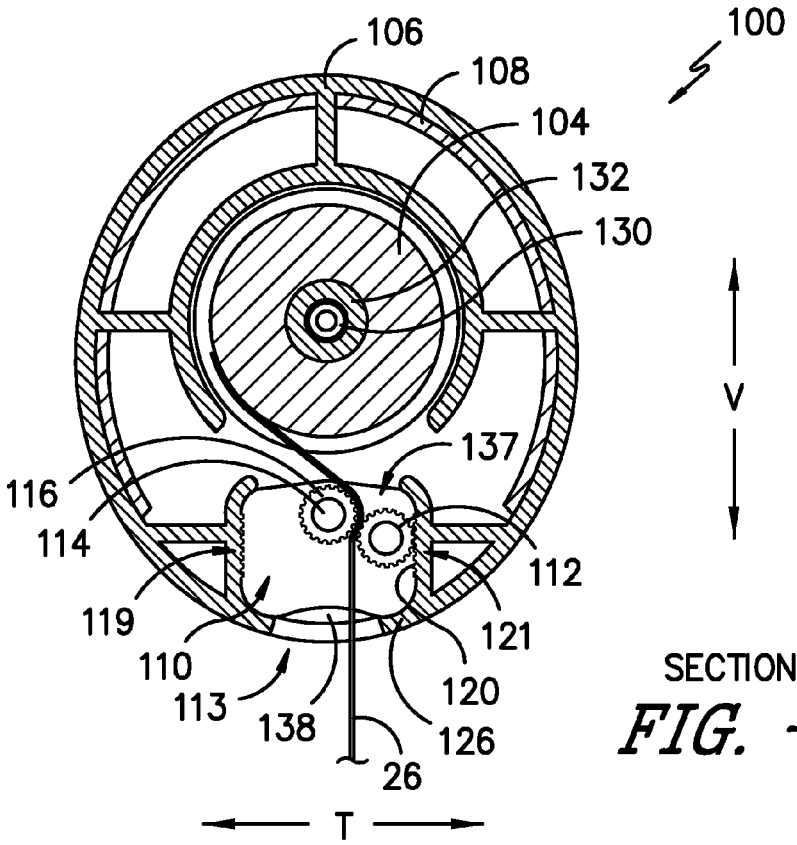
SECTION B–B
FIG. –11–

SHADE LOCK ASSEMBLY

FIELD OF THE DISCLOSURE

The present subject matter relates generally to a shade lock assembly for retractable shades, blinds, and other coverings.

BACKGROUND OF THE DISCLOSURE

Retractable coverings for architectural openings such as windows, doors, archways and the like, have become commonplace and assume numerous variations for both functional and aesthetic purposes. Such retractable coverings typically include a headrail, in which the working components for the covering are primarily confined, a bottom rail generally extending parallel to the headrail, and some form of shade, which may be fabric or other manipulative structure, interconnecting the headrail and bottom rail. The shade is movable with the bottom rail between an extended and retracted position relative to the headrail. In other words, as the bottom rail is lowered or raised relative to the headrail, the fabric or other material is extended away from the headrail or retracted toward the headrail so it can be accumulated either adjacent to or within the headrail.

Other retractable coverings may utilize a roller shade configuration. In these coverings, the shade is rolled around a core and rotatably mounted using an mounting assembly. The shade is rotated in a first direction, or unrolled, to extend the shade and rotated in a second and opposite direction, or rolled-up, to retract the shade.

Systems for operating such retractable coverings can assume various forms as well. For example, a continuous loop drive assembly may be provided, positioned at a left end and/or right end of the headrail or mounting assembly. The continuous loop drive assembly may include a continuous loop pull cord operatively connected to the shade. With such a construction, the user may extend or retract the shade by pulling on opposite sides of the continuous loop pull cord.

However, certain problems may exist with the above configuration. For example, current continuous loop drive assemblies require an anchor mounted in the architectural opening below the mounting assembly. This may add to the cost and complication of the shade assembly and present an unpleasant appearance for the shade assembly. Accordingly, a system for operating a roller shade that does not require a continuous loop drive assembly would be useful. Moreover, a shade lock assembly that allows for an aesthetically pleasing appearance would be particularly useful.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 10 provides a front cross-sectional view of the exemplary shade lock assembly of FIG. 3, taken along line C-C of FIG. 7;

FIG. 11 provides a side cross-sectional view of the exemplary shade lock assembly of FIG. 3, taken along line B-B of FIG. 6, with the roller wheel in the locked position;

DETAILED DESCRIPTION OF THE INVENTION

Figure 1:
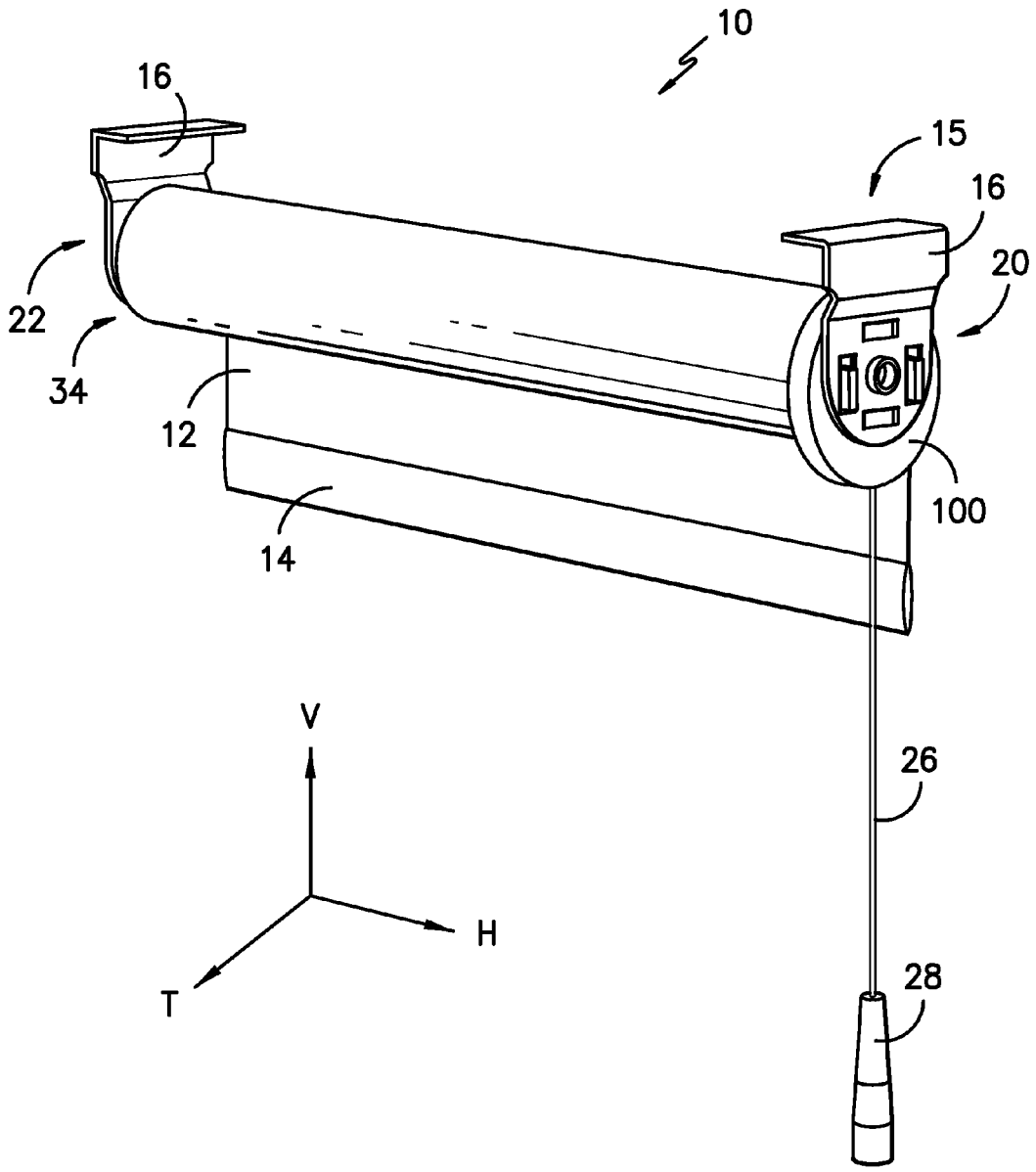
FIG. 1 provides a perspective view of a shade assembly in accordance with exemplary aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a direct drive shade lock assembly for an extendable and retractable shade assembly that may reduce an amount of friction and resistance on a pull cord and allow for a single pull cord to extend or retract a shade in the shade assembly. Accordingly, a shade lock assembly in accordance with certain exemplary embodiments of the present disclosure may provide for enhanced child safety features and provide for a shade assembly with a more aesthetically pleasing, clean, and slick appearance. Additionally, a shade lock assembly in accordance with certain exemplary embodiments of the present disclosure may allow a user to lock the pull cord in place without having to move the pull cord to the left or right relative to the shade assembly.

Figure 2:
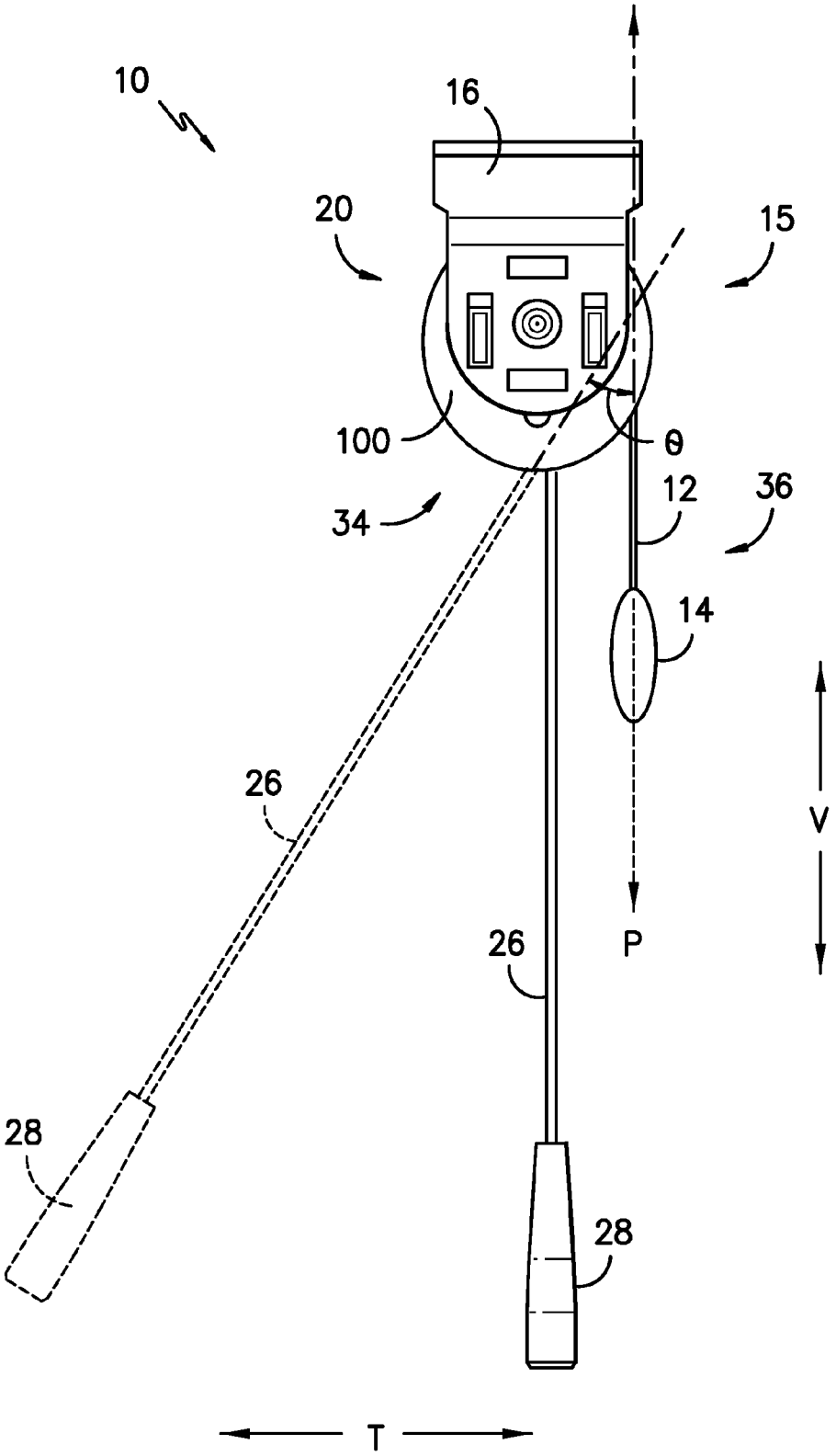
FIG. 2 provides a side view of the exemplary shade assembly of FIG. 1.

With reference now to the FIGS., FIGS. 1 and 2 provide a perspective view and a side view, respectively, of a shade assembly 10 in accordance with an exemplary embodiment of the present disclosure. The exemplary shade assembly 10 of FIGS. 1 and 2 generally includes a mounting assembly 15 and a shade 12, wherein the mounting assembly 15 includes a mount 16 positioned at a first end 20 and a mount 16 positioned at a second end 22. A roller tube (not shown) extends between the first and second ends 20, 22. Moreover, the shade assembly 10 defines a front side 34, a rear side 36, and a central plane P positioned therebetween (see FIG. 2). The central plane P may be defined by a longitudinal direction of the shade 12 and a latitudinal, or crosswise, direction of the shade 12. For the exemplary embodiment of FIGS. 1 and 2, the longitudinal direction of the shade 12 corresponds to a vertical direction V and the latitudinal, or crosswise, direction of the shade 12 corresponds to a horizontal direction H. Additionally, the first end 20 corresponds to a right end of the mounting assembly 15, and the second end 22 corresponds to a left end of the mounting assembly 15. As used herein the right end refers to the portion of the mounting assembly 15 right of center when facing the front 34, and the left end refers to the portion of the mounting assembly 15 left of center when facing the front 34. The shade assembly 10 further defines a transverse direction T orthogonal to the central plane P (see FIG. 2).

Referring still to FIGS. 1 and 2, the mounting assembly 15 additionally includes a shade lock assembly 100 positioned at the first end 20. As will be discussed below, with reference to FIGS. 3 through 13, for the exemplary embodiment of FIGS. 1 and 2, the shade lock assembly 100 may interact with the roller tube and may be configured to rotate the roller tube to control or operate the shade 12. Moreover, the shade lock assembly 100 includes a pull cord 26 with a tassel 28 attached thereto to assist a user in moving the pull cords 26 inwardly or outwardly relative to the mounting assembly 15. As exemplified by the pull cord 26 shown in phantom in FIG. 2, the pull cord may define an angle θ with the central plane P of the shade assembly.

The shade 12 of the exemplary shade assembly 10 of FIGS. 1 and 2 is a rolled shade wrapped around the roller tube of the mounting assembly 15. The shade 12 extends longitudinally between an extended position and a retracted position. The shade 12 may be extended by rotating the roller tube in a first direction (such as a clockwise direction when viewing the shade assembly 10 from the first end 20) and retracted by rotating the roller tube in a second direction (such as a counter-clockwise direction when viewing the shade assembly 10 from the first end 20). The shade 12 may unroll as it is extended and roll-up as it is retracted. The shade 12 additionally includes a weighted ballast member 14 positioned at an end of the shade 12. The weighted ballast member 14 may bias the shade 12 of the exemplary shade assembly 10 towards the extended position and assist in ensuring an extended portion of the shade 12 hangs in a desired manner. For example, the ballast member 14 may weigh down the end of the shade 12, such that the extended portion of the shade 12 hangs generally in the vertical direction V.

It should be appreciated, however, that the exemplary shade assembly 10 of FIGS. 1 and 2 is provided by way of example only, and in other exemplary embodiments, the shade assembly 10 may have any other suitable configuration. For example, in other exemplary embodiments the shade lock assembly 100 may be positioned at the second end 22 of the shade assembly 10 as opposed to the first end 20 as is shown in FIGS. 1 and 2.

It should also be appreciated that in still other exemplary embodiments of the present disclosure, the shade 12 may not be a rolled shade, and instead may have any other suitable shade configuration for, e.g., blocking light, providing privacy, increasing the aesthetic appeal of a room and/or allowing a desired amount of light into a room. For example, in other exemplary embodiments, the shade 12 may be horizontal blinds, roman shades, cellular shades, or any other suitable shade or blind. Moreover, in any of the above embodiments, the shade 12 may by comprised of any suitable fabric or material, such as a sheer, laminate, wood, faux wood, and/or woven material.

Figure 3:
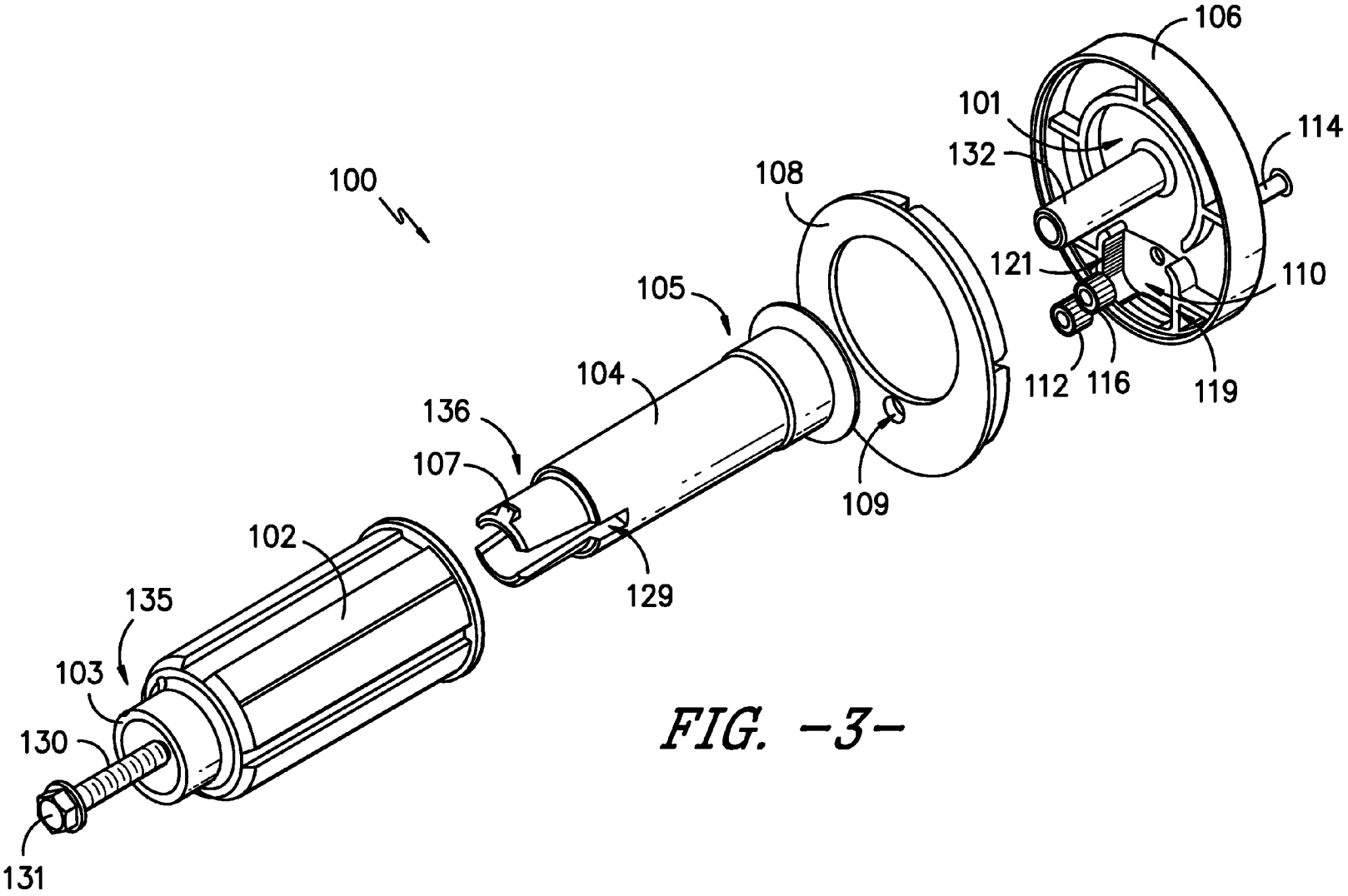
FIG. 3 provides an exploded perspective view of a shade lock assembly in accordance with exemplary aspects of the present disclosure.
Figure 4:
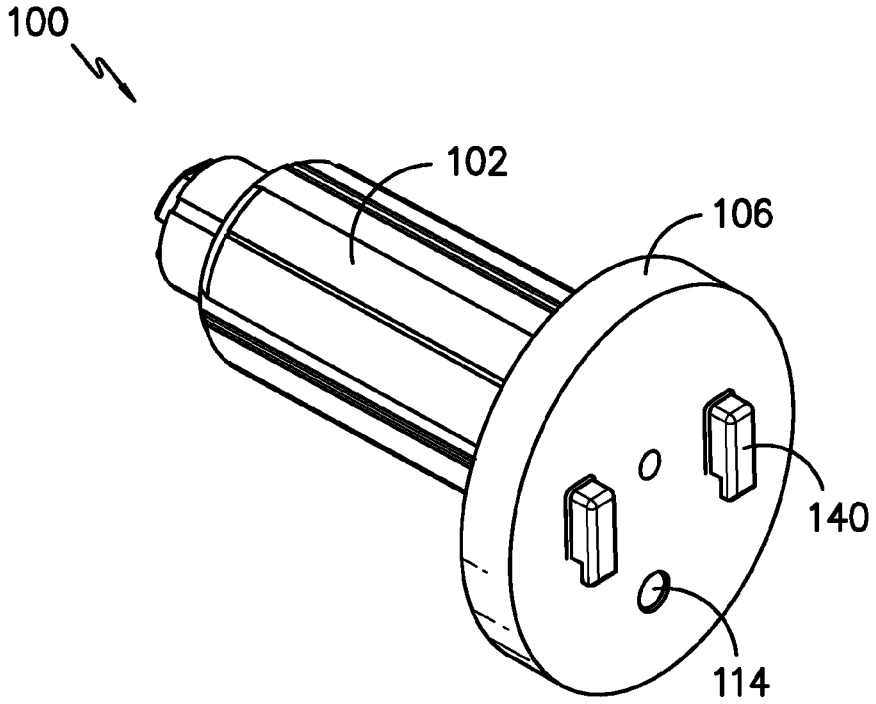
FIG. 4 provides an outside perspective view of the exemplary shade lock assembly of FIG. 3.
Figure 5:
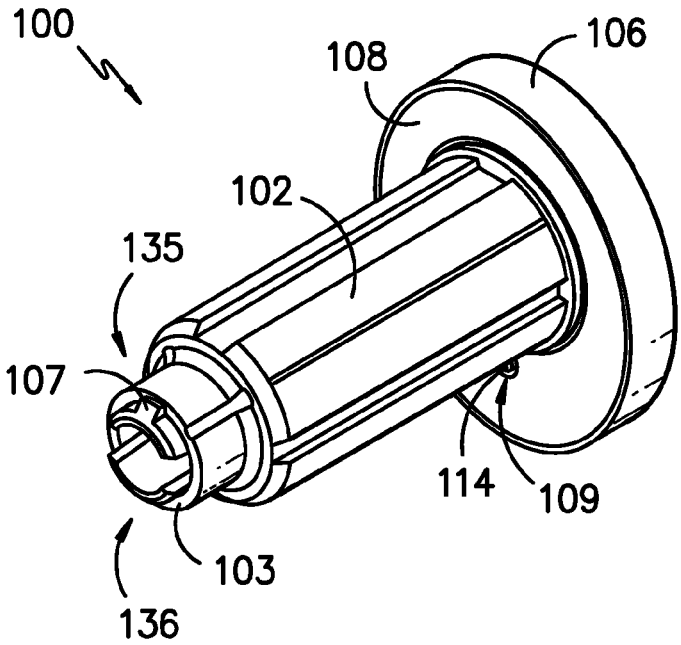
FIG. 5 provides an inside perspective view of the exemplary shade lock assembly of FIG. 3.
Figure 6:
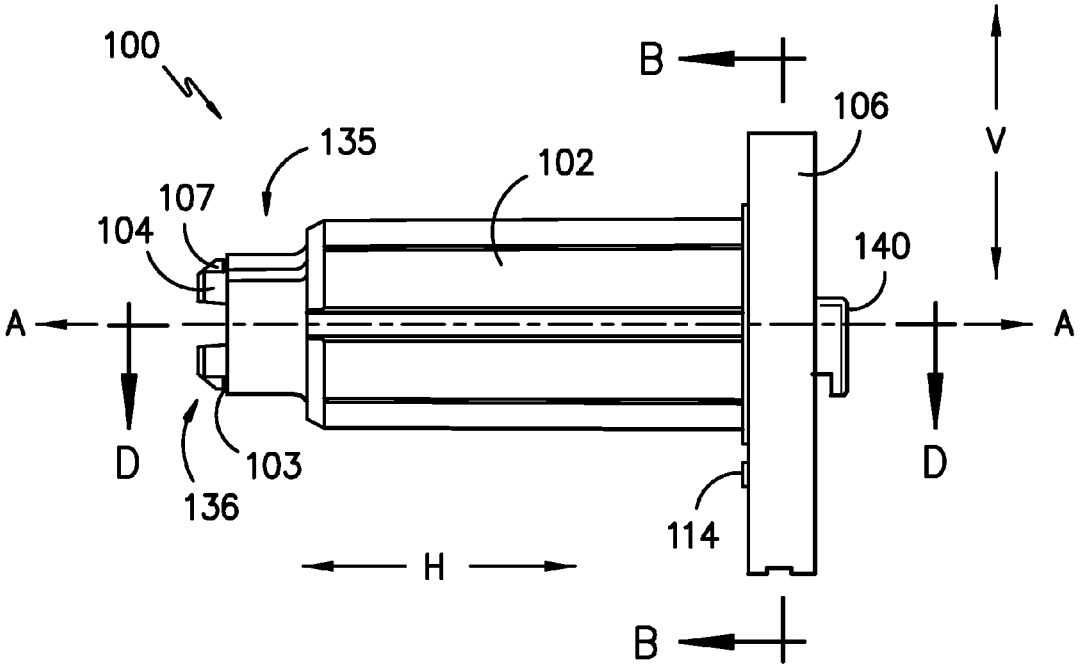
FIG. 6 provides a front view of the exemplary shade lock assembly of FIG.
Figure 7:
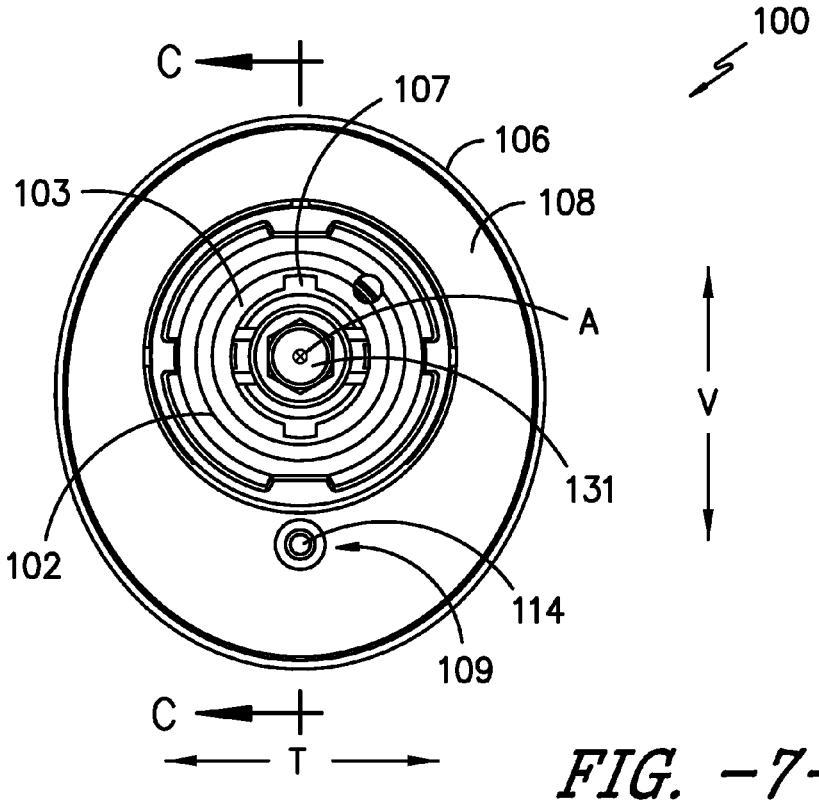
FIG. 7 provides an inside view of the exemplary shade lock assembly of FIG. 3.
Figure 8:
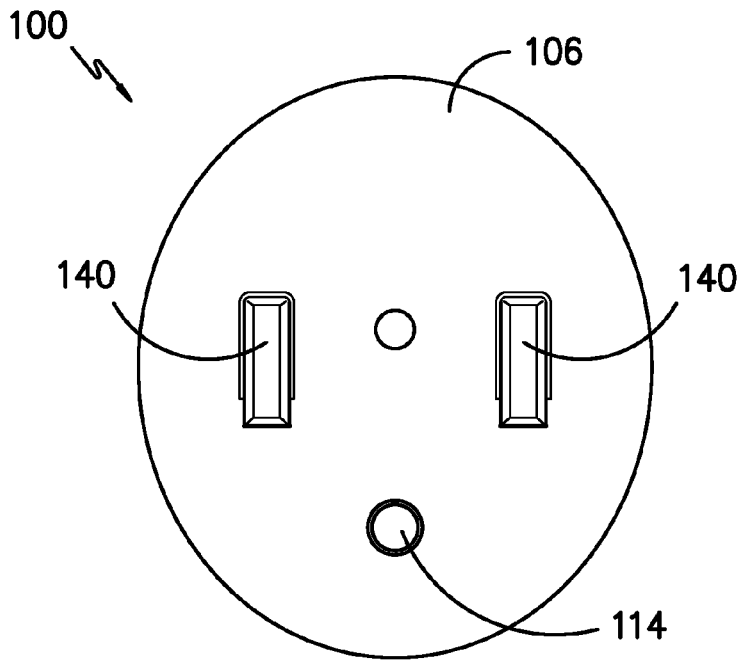
FIG. 8 provides an outside view of the exemplary shade lock assembly of FIG. 3.
Figure 9:
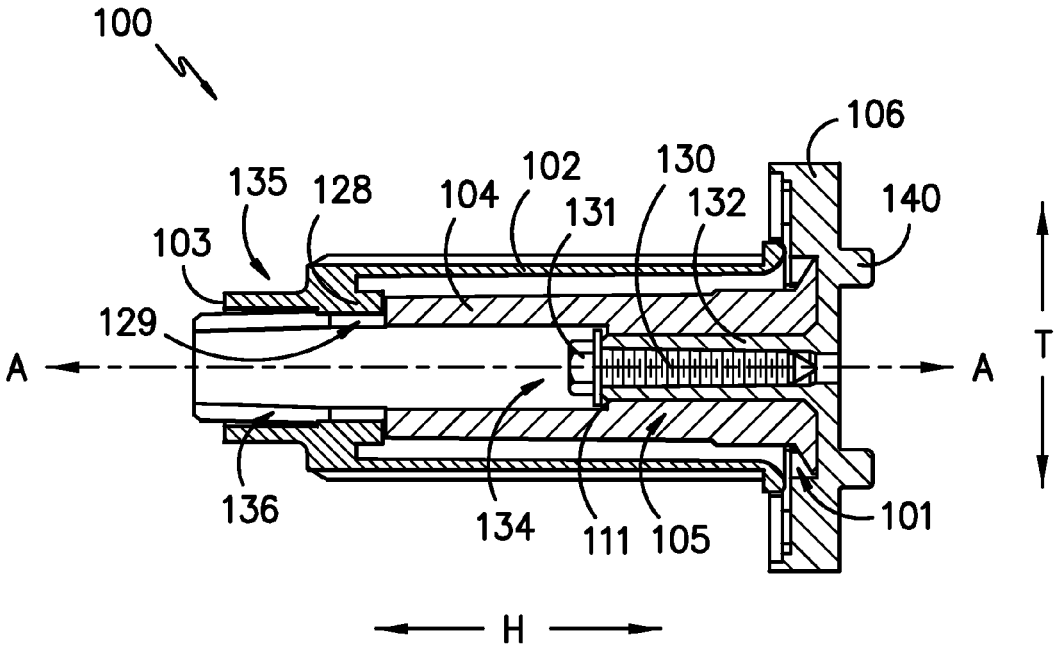
FIG. 9 provides a top cross-sectional view of the exemplary shade lock assembly of FIG. 3, taken along line D-D of FIG. 6.
Figure 12:
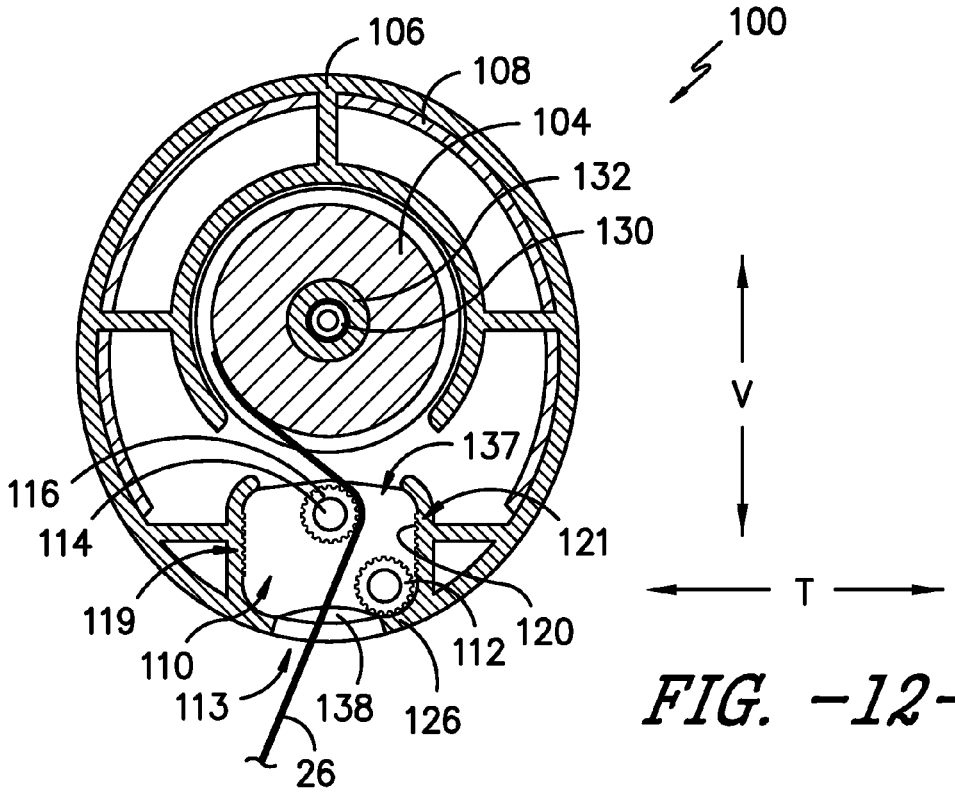
FIG. 12 provides a side cross-sectional view of the exemplary shade lock assembly of FIG. 3, taken along line B-B of FIG. 6, with the roller wheel in the unlocked position.

Referring now generally to FIGS. 3 through 12, various views of an exemplary shade lock assembly 100 are provided. Specifically, FIG. 3 provides an exploded perspective view of an exemplary shade lock assembly 100. FIGS. 4 and 5 provide an outside perspective view and an inside perspective view, respectively, of the exemplary shade lock assembly 100 of FIG. 3. Additionally, FIG. 6 provides a front view of the exemplary shade lock assembly 100 of FIG. 3. FIGS. 7 and 8 provide an inside view and an outside, respectively, of the exemplary shade lock assembly 100 of FIG. 3. Further, FIG. 9 provides a top cross-sectional view of the exemplary shade lock assembly 100 of FIG. 3, taken along line D-D of FIG. 6, and similarly. FIG. 10 provides a front cross-sectional view of the exemplary shade lock assembly 100 of FIG. 3, taken along line C-C of FIG. 7. Moreover, FIGS. 11 and 12 provide side cross-sectional views of the exemplary shade lock assembly 100 of FIG. 3, taken along line B-B of FIG. 6. More particularly, FIG. 11 depicts the exemplary shade lock assembly 100 of FIG. 3 with the roller wheel in the locked position, while FIG. 12 depicts the exemplary shade lock assembly 100 of FIG. 3 with the roller wheel in the unlocked position.

Referring specifically to FIG. 3, an exploded perspective view of an exemplary shade lock assembly 100 is provided. The exemplary shade lock assembly 100 generally includes a spool 104 positioned adjacent to a housing 106. A screw 130 is provided to attach the spool 104 to the housing 106. The housing 106 defines a pull cord channel 110 extending generally along a vertical direction V, the pull cord channel 110 defining a first wall 119 and an opposite second wall 121. More particularly, for the embodiment of FIG. 3, the first wall 119 is a front wall, configured to be positioned towards to the front 34 of the shade assembly 10, and the second wall 121 is a rear wall, configured to be positioned towards the rear 36 of the shade assembly 10. The housing 106 further includes a pin 114 extending through the pull cord channel 110, between the first and second walls 119, 121. The exemplary shade lock assembly 100 of FIG. 3 also includes a stationary wheel 116 rotatably mounted to the pin 114 and a roller wheel 112 positioned along the second wall 121 of the pull cord channel 110. A housing cap 108 is positioned over at least a portion of the housing 106 to cover the pull cord channel 110, and a spool cover 102 is positioned over at least a portion of the spool 104. The spool cover 102 includes a pair of notches 128 (see FIG. 9) configured to fit into a pair of slots 129 defined by the spool 104.

Operation of the exemplary shade lock assembly 100 may be more clearly seen with reference to FIGS. 9 through 12. With reference specifically to the top and front cross-sectional views of FIGS. 9 and 10, the spool 104 defines a base 105 and a central axis A. The spool 104 also defines an opening 134 extending along the axis A, with a ledge 111 where a diameter of the opening 134 decreases at a beginning of the base 105. Additionally, the spool 104 is rotatably connected to the housing 106, such that the spool 104 may rotate about its central axis A relative to the housing 106. More particularly, the housing 106 defines a spool cavity 101 with at least a portion of the base 105 of the spool 104 positioned in the spool cavity 101. The housing 106 additionally defines a post 132 that extends into the opening 134 of the spool 104, along the axis A of the spool 104. As shown in the FIGS., the screw 130 is configured to attach to the post 132 of the housing 106 and hold the spool 104 in position adjacent to the housing 106. More particularly, the screw 130 includes a screw head 131. The screw head 131 is configured to abut the ledge 111 defined in the opening 134 of the spool 104 if the spool 104 begins to move away from the housing 106, although normally a clearance may be provided between the screw head 131 and the ledge 111. Accordingly, the screw head 131 may prevent the spool 104 from detaching from the housing 106 when the screw 130 is positioned in the post 132.

As stated, the spool cover 102 is positioned over at least a portion of the spool 104. More particularly, the spool cover 102 attaches to the spool 104 and is configured to rotate with the spool 104. For the exemplary embodiment of FIGS. 9 and 10, an inside end 135 of the spool cover 102 has a shape that is complementary to an inside end 136 of the spool 104 (i.e., the spool cover 102 is "keyed" to the spool 104), such that movement of the spool cover 102 relative to the spool 104 is limited. For example, the spool 104 includes a pair of snaps 107 positioned at the inside end 136 of the spool 104 and the spool cover 102 defines an inside lip 103 at its inside end 135. When the spool cover 102 is positioned around the spool 104, the snaps 107 of the spool 104 extend around the inside lip 103 of the spool cover 102 preventing the spool cover 102 from moving relative to the spool 104 along the axis A of the spool 104. Additionally, as discussed above with reference to FIG. 3, the spool cover 102 defines a pair of notches 128 positioned in a corresponding pair of slots 129 defined in the spool 104. Such a configuration may prevent the spool cover 102 from rotating relative to the spool 104 about the central axis A of the spool 104.

In certain exemplary embodiments, the spool cover 102 of the exemplary shade lock assembly 100 may be positioned at least partially in the roller tube of the exemplary shade assembly 10 of FIGS. 1 and 2. In such an exemplary embodiment, rotating the spool 104 about its central axis A, may in turn rotate the spool cover 102 and the spool cover 102 may drive the roller tube of the shade assembly 10. Accordingly, in such an exemplary embodiment, rotating the spool 104 may extend or retract the shade 12 of the shade assembly 10.

The housing 106 further defines a pair of mounting attachments 140. The attachments 140 may, for example, be used to attach the shade lock assembly 100 to the mounts 16 depicted in the exemplary shade assembly 10 of FIGS. 1 and 2.

It should be appreciated, however, that the spool 104, spool cover 102, and housing 106 are provided by way of example only. In other exemplary embodiments of the present disclosure, any other spool 104, spool cover 102, and housing 106 configuration may be provided. For example, in other embodiments, the spool 104 may be rotatably connected to the housing 106 in any other suitable manner, or alternatively, the spool 104 and housing 106 may not be connected. Additionally, the spool cover 102 may be attached to the spool 104 in any suitable manner, such as by utilizing a glue or an epoxy. Alternatively, in still other exemplary embodiments, the shade lock assembly 100 may not include a separate spool cover 102. In such an exemplary embodiment, the spool 104 and spool cover 102 may be co-molded as a single piece, or alternatively it may be excluded altogether. Moreover, in still other exemplary embodiments, the pull cord 26 may be attached to the spool cover 102 instead of the spool 104. In such an exemplary embodiment, the spool cover 102 may not be keyed to the spool 104, and the pull cord 26 may ensure the spool 104 and spool cover 102 rotate together.

Referring now specifically to FIGS. 11 and 12, the pull cord channel 110 is shown in greater detail. The pull cord channel 110 includes a pin 114 extending therethrough generally in a direction parallel to the central axis A of the spool 104 and defines an opening 113 and a ledge 138 (see also FIG. 10). For the exemplary embodiment of FIGS. 11 and 12, the pin 114 is a separate metal pin 114 extending through an opening in the housing 106 and through a corresponding opening 109 in the housing cap 108 (see FIG. 3). The exemplary pull cord channel 110 additionally includes the stationary wheel 116 rotatably attached to the pin 114 and the roller wheel 112. The roller wheel 112, by contrast, is movably positioned in the pull cord channel 110 along a length of the pull cord channel 110. More particularly, the roller wheel 112 is configured to rotate and move along the second wall 121 of the pull cord channel 110, which for the exemplary embodiment of FIGS. 11 and 12 corresponds to a movement along the vertical direction V. Additionally, a bottom ledge 126 is defined by the pull cord channel 110 adjacent to the opening 113 to ensure the roller wheel 112 stays in the appropriate position.

It should be appreciated, however, that in other exemplary embodiments, the above components may have any other suitable configuration. For example, in other exemplary embodiments, the pin 114 may be any other suitable material, such as a plastic, and additionally, or alternatively, may be co-molded with the housing 106 or the housing cap 108. Further, in other exemplary embodiments, the stationary wheel 116 may not be rotatably attached to the pin 114. In such an embodiment, the pin 114 may be configured to rotate. Alternatively, the pull cord channel 110 may not include a stationary wheel altogether, and may instead just include the pin 114. In still other exemplary embodiments, the pull cord channel 110 may not include a stationary wheel 116 or a pin 114, and instead may include any other suitable turning surface. For example, the first wall 119 of the pull cord channel 110 may narrow to where the pin 114 is depicted in the FIGS. to interact with the pull cord 26 and roller wheel 112 as discussed below.

Moreover, the opening 113 of the pull cord channel 110 may have any suitable shape. For example, the shape of the opening 113 and ledge 138 may be configured to prevent the roller wheel 112 from leaving the pull cord channel 110. In such an exemplary embodiment, the opening 113 may define a length along the horizontal direction H less than a length of the roller wheel 112 along the horizontal direction H. Moreover, in other exemplary embodiments, the pull cord channel 110 may define a roller wheel guide slot along its length and the roller wheel 112 may include a corresponding guide member, such as a "T"-shaped guide member or nailhead-shaped guide member. In such an embodiment, the roller wheel guide slot may ensure the roller wheel 112 moves along a desired path. Further, in other exemplary embodiments, the pull cord channel 110 may include a cam connected to the roller wheel 112 and the pull cord 26, in such an embodiment, the cam may be configured to interact with the bottom ledge 126 and lift the roller wheel 112 in a vertical direction in response to the pull cord 26 being moved inwardly relative to the central plane P.

Referring still to the exemplary embodiment of FIGS. 11 and 12, the pull cord 26 extends through the pull cord channel 110, between the stationary and roller wheels 116, 112 and around the spool 104. More particularly, the pull cord 26 extends up through the pull cord channel 110 and clockwise around the spool 104 (when viewed from the outside cross-sectional view of FIGS. 11 and 12). Accordingly, in certain exemplary embodiments, the shade lock assembly 100 of FIGS. 11 and 12 may be used in the exemplary shade assembly 10 of FIGS. 1 and 2, positioned on the first end 20 of the shade assembly 10 of FIGS. 1 and 2. In such an embodiment, moving the pull cord 26 outwardly relative to the mounting assembly 15 may rotate the stationary wheel 116 clockwise and the spool 104 counter-clockwise such that the shade 12 is retracted. Additionally, moving the pull cord 26 inwardly relative to the mounting assembly 15 may rotate the stationary wheel 116 counter-clockwise and the spool 104 clockwise such that the shade 12 is extended.

As discussed above, FIG. 11 depicts the roller wheel 112 in the locked position, and FIG. 12 depicts the roller wheel 112 in the unlocked position. More particularly, when in the locked position, the area between the roller wheel 112 and the stationary wheel 116 in the pull cord channel 110 is minimized such that the pull cord 26 is pinched between the roller wheel 112 and the stationary wheel 116 (see FIG. 11). Such functionality is provided at least in part due to a gap 137 in the pull cord channel 110 between the second wall 121 and the stationary wheel 116 having a width along the transverse direction T less than an effective width of the roller wheel 112 and pull cord 26, as is shown in FIG. 11. By contrast, when in the unlocked position, the roller wheel 112 is positioned vertically lower in the pull cord channel 110, or away from the stationary wheel 116 in the pull cord channel 110 (see FIG. 12). Accordingly, when in the unlocked position, the pull cord 26 may be able to pass freely through the pull cord channel 110 and directly to the spool 104, without being stopped by the roller wheel 112 and stationary wheel 116.

For the exemplary shade lock assembly 100 of FIGS. 10 and 11, the roller wheel 112 may be moved to the locked position by decreasing the angle θ defined by the pull cord 26 and the central plane P (see FIG. 2) to less than about 45 degrees and by moving the pull cord 26 inwardly relative to mounting assembly 15. It should be appreciated, however, that in other exemplary embodiments, the roller wheel 112 may instead be moved to the locked position by decreasing the angle θ to an angle less than about 60 degrees, less than about 30 degree, or less than about 15 degrees. Moreover, it should be appreciated that the ranges hereby provided are by way of example only, and in other exemplary embodiments, the roller wheel 112 may be moved to a locked position when the angle θ is decreased to any suitable angle.

Referring still to FIGS. 10 and 11, decreasing the angle θ of the pull cord 26 may allow the pull cord 26 to interact with the roller wheel 112 and rotate the roller wheel 112 as the pull cord 26 is moved inwardly relative to the mounting assembly 15. The roller wheel 112 may, in turn, interact with the second wall 121 of the pull cord channel 110 such that the roller wheel 112 is moved up, or "walked-up," the second wall 121 of the pull cord channel 110 as it is rotated by the pull cord 26. The roller wheel 112 may then press the pull cord 26 against the stationary wheel 116, such that the pull cord 26 is pinched between the roller and stationary wheels 112, 116. Notably, the bias of the shade 12 towards an extended position (which for the exemplary embodiment of FIGS. 1 and 2 may be due in part to the inclusion of a weighted ballast member 14), may keep tension on the pull cord 26 and hold the roller wheel 112 in the locked position.

For the exemplary embodiment of FIGS. 11 and 12, the roller wheel 112 and stationary wheel 116 are serrated roller wheels and thus define a plurality of circumferential ridges. The circumferential ridges on the wheels 112, 116 may allow for increased traction between the wheels 112, 116 and the pull cord 26. Moreover, the circumferential ridges on the roller wheel 112 additionally correspond to a plurality of ridges 120 defined by the second wall 121 of the pull cord channel 110. The circumferential ridges of the roller wheel 112 are configured to interact with the plurality of ridges 120 defined by the second wall 121 of the pull cord channel 110 such that rotating the roller wheel 112 moves the roller wheel 112 along the second wall 121 of the pull cord channel 110. Such a construction may improve the locking function of the roller wheel 112 by minimizing any slippage between the second wall 121 and the roller wheel 112, between the roller wheel 112 and the pull cord 26, and between the pull cord 26 and stationary wheel 116. Additionally, as shown, a lower portion of the second wall 121 defines a smooth surface. The smooth surface may allow the roller wheel 112 to rotate more smoothly when, for example, the pull cord 26 is being moved outwardly relative to the mounting assembly 15.

It should be appreciated, however, that in other exemplary embodiments of the present disclosure, the stationary wheel 116, the roller wheel 112, and the second wall 121 may have any other suitable construction. For example, in other exemplary embodiments, only one of the stationary wheel 116, the roller wheel 112, or second wall 121 may have ridges, or alternatively, one or more of the stationary wheel 116, the roller wheel 112, and the second wall 121 may instead include a "gritty" surface or neural surface to increase traction with the pull cord 26 or one another. The gritty surface may be, for example, a sandpaper-type surface, and the neural surface may be, for example, a diamond pattern Referring still to the exemplary shade lock assembly 100 of FIGS. 11 and 12, the roller wheel 112 may, by contrast, be moved to an unlocked position (see FIG. 12) by increasing the angle θ defined by the pull cord 26 and the central plane P to an angle greater than about 45 degrees and by moving the pull cord 26 outwardly relative to the mounting assembly 15. It should be appreciated, however, that in other exemplary embodiments, the roller wheel 112 may instead be moved to the unlocked position by increasing the angle θ to an angle greater than about 15 degrees, greater than about 30 degrees, or greater than about 60 degrees. Moreover, it should be appreciated that the ranges hereby provided are by way of example only, and in other exemplary embodiments, the roller wheel 112 may be moved to an unlocked position when the angle θ is increased to any suitable angle.

Additionally, by moving the pull cord 26 outwardly relative to the mounting assembly 15, the pull cord 26 may interact with the roller wheel 112, rotating the roller wheel 112 and moving it vertically downward along the second wall 121 within the pull cord channel 110. More particularly, for the exemplary embodiment of FIGS. 11 and 12, the roller wheel 112 may rotate counter-clockwise to move from the locked position into the unlocked position. Once the roller wheel 112 has moved far enough down and away from the stationary roller 116, such that it no longer presses the pull cord 26 against the stationary wheel 116, gravity may cause the roller wheel 112 to drop vertically downward into the unlocked position.

A shade lock assembly 100 having such a configuration may have many benefits. For example, such a configuration may allow a user to operate the shade assembly 10 with a single pull cord 26 and without the use of a continuous loop drive assembly and anchor, providing a more aesthetically pleasing and clean appearance. Additionally, with such a configuration, a user may move the roller wheel 112 of the shade lock assembly 100 into a locked position by moving the pull cord 26 in a transverse direction T towards the central plane P of the shade 12 and inwardly relative to the mounting assembly 15. Further, with such a configuration, a user may move the roller wheel 112 into an unlocked position by moving the pull cord 26 in a transverse direction T away from the central plane P and outwardly relative to the mounting assembly 15. This may allow for greater ease of operation when, for example, the shade assembly 10 is positioned in an architectural opening adjacent to a wall or positioned adjacent to a large piece of furniture.

Moreover, when the roller wheel 112 is in the unlocked position, such as is shown in the cross-sectional view of FIG. 12, movement of the pull cord 26 through the pull cord channel 110 may be simplified and the pull cord 26 may extend around only the stationary wheel 116 prior to reaching the spool 104. Such a configuration may reduce the amount of friction and resistance in the shade lock assembly 100, as such a configuration minimizes the direction changes (and contact with the associated turning surfaces) required of the pull cord 26 prior to reaching the spool 104. Additionally, when the stationary wheel 116 is rotatable about the pin 114 (or when the pin 114 is rotatable), the friction and resistance on the pull cord 26 due to the direction change is minimized. Accordingly, the exemplary shade lock assembly 100 of FIGS. 3 through 12 may make it easier for a user to, e.g., extend or retract the shade 12. The above benefits may be further enhanced by using a single pull cord 26 in the shade lock assembly 100, which is possible due to the unique construction of the exemplary shade lock assembly 100.

It should be appreciated, however, that the exemplary shade lock assembly 100 of FIGS. 3 through 12 is provided by way of example only, and in other exemplary embodiments, the shade lock assembly 100 may have any other suitable configuration. For example, although the pull cord channel 110 of the exemplary shade lock assembly 100 of FIGS. 3 through 12 is oriented generally in the vertical direction V, in other exemplary embodiments, the pull cord channel 110 may be oriented at an angle relative to the vertical direction V or relative to the central plane P of the shade assembly 10. In such an exemplary embodiment, the minimum angle θ of the pull cord 26 for moving the roller wheel 112 into an unlocked position may be increased or decreased, and similarly, the minimum angle θ of the pull cord for moving the roller wheel 112 into a locked position may be increased or decreased.

It should also be appreciated that in still other exemplary embodiments of the present disclosure, the pull cord channel 110 may be rotated 90 degrees about the vertical direction V within the cord lock assembly 100, such that the roller 112 is moved between the locked and unlocked position by moving the pull cord 26 from side to side along the horizontal direction H. In such an exemplary embodiment, the angle θ may instead be defined between the pull cord 26 and a transverse plane defined by the vertical direction V and the transverse direction T.

Moreover, it should be appreciated that in still other exemplary embodiments, the operation of the shade lock assembly 100 may be reversed. More particularly, in other exemplary embodiments, the roller wheel 112 may instead be positioned adjacent to and configured to move along the first wall 119 (depicted in FIGS. 11 and 12 as the front wall). In such an exemplary embodiment, the pull cord 26 may extend up the pull cord channel 110, between the roller and stationary wheels 112, 116, and counter-clockwise around the spool 104 (when viewed from the outside view of FIGS. 10 and 11). Moreover, a shade lock assembly having such a configuration may be used in a shade assembly similar to the exemplary shade assembly 10 of FIGS. 1 and 2, positioned on the second end, or left end 22, of the mounting assembly 15.

Figure 13:
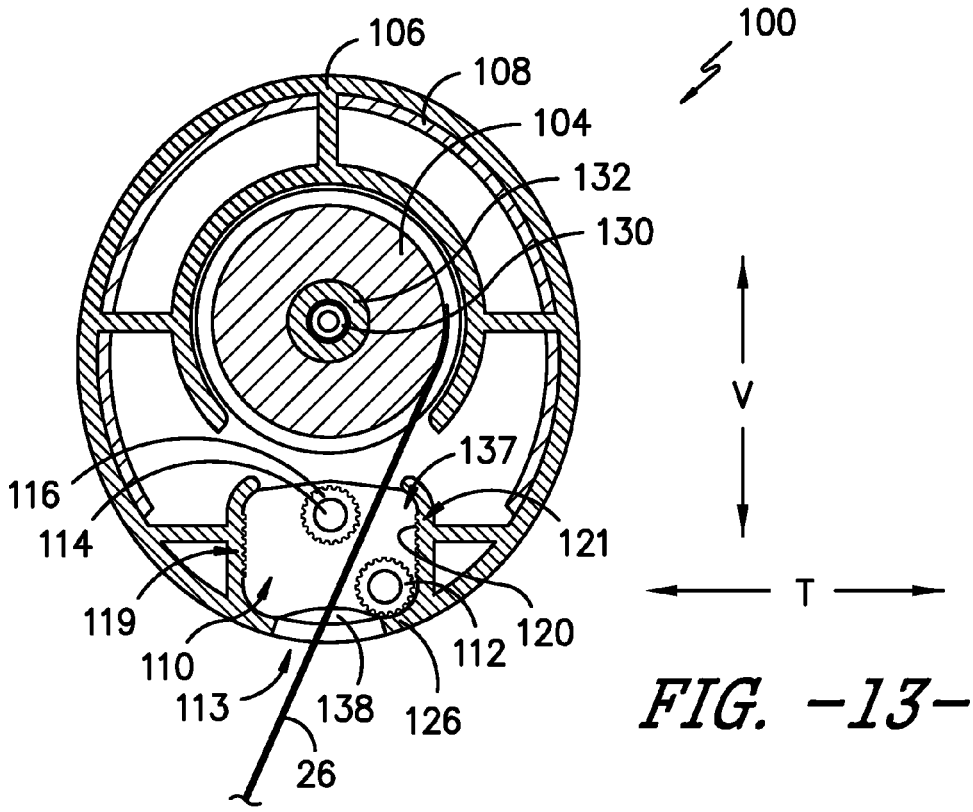
FIG. 13 provides a side cross-sectional view of another exemplary shade lock assembly in accordance with the present disclosure.

Referring now to FIG. 13, another exemplary embodiment of the present disclosure is provided. More particularly, FIG. 13 provides a cross-sectional view of another exemplary shade lock assembly 100, similar to the view of FIG. 12, wherein the turning direction of the spool 104 has been reversed (as compared to the exemplary shade lock assembly 100 of FIG. 12). More particularly, the turning direction of the outer spool 104 is reversed by directing the pull cord 26 directly around the spool 104, such that the pull cord 26 extends up through the pull cord channel 110, between the stationary and roller wheels 116, 112, and counter-clockwise around the spool 104 (when viewed from the outside cross-sectional view of FIG. 13). Operation of the exemplary shade lock assembly of FIG. 13 may be similar to the exemplary shade lock assembly 100 of FIGS. 3 through 12, with the exception of the turning direction of the spool. Accordingly, for the exemplary embodiment of FIG. 13, moving the pull cord 26 outwardly relative to the mounting assembly 15 rotates the spool 104 in a clockwise direction (when viewed from the outside, as in FIG. 13), and moving the pull cord 26 inwardly rotates the spool 104 in a counter-clockwise direction (when viewed from the outside, as in FIG. 13).

The exemplary shade lock assembly 100 of FIG. 13 may be used in a shade assembly 10 with a "reverse roll" configuration. More particularly, the exemplary shade lock assembly 100 of FIG. 13 may be used when the shade 12 is configured to extend from the front 34 of the shade assembly 10/of the roller tube (as opposed to from the rear 36, as is shown in FIGS. 1 and 2).

Moreover, one of ordinary skill in the art will readily appreciate from the teachings herein that the exemplary shade assembly 10 and exemplary shade lock assembly 100 described and illustrated with respect to the FIGS. above may provide a method for locking and unlocking a cord in a shade assembly. For example, the method may include raising a shade in a shade assembly to a desired position by moving or pulling a pull cord outwardly relative to a mounting assembly. Raising the shade may include lifting a bottom rail or intermediate rail, or alternatively may include rotating a rolled shade about a roller tube. The method may additionally include moving the pull cord inwardly relative to a central plane defined by the shade assembly in a transverse direction such that an angle defined, between the pull cord and the central plane of the shade assembly is less than a predetermined limit. Additionally, the method may include moving the pull cord inwardly relative to the mounting assembly, such that the pull cord interacts with a roller wheel rotatably positioned in the pull cord channel, and pinching the pull cord between the roller wheel and a stationary wheel positioned in the pull cord channel. The interaction of the pull cord with the roller wheel may cause the roller wheel to rotate and move vertically upwards.

Furthermore, the method may additionally include moving the roller wheel to an unlocked position. Moving the roller wheel to the unlocked position may include moving the pull cord outwardly relative to the central plane of the shade assembly in a transverse direction such that an angle defined by the pull cord and the central plane is greater than a predetermined limit. Additionally, moving the roller wheel to the unlocked position may include moving the pull cord outwardly relative to the mounting assembly, such that the pull cord interacts with and rotates the roller wheel vertically downward in the pull cord channel. The roller wheel may then drop vertically downward in the pull cord channel into the unlocked position due to gravity.

It should be appreciated, however, in other exemplary aspects of the present disclosure, moving the roller to a locked position or an unlocked position may instead include moving the pull cord in a side to side direction. More particularly, moving the roller to a locked position or an unlocked position may include decreasing or increasing, respectively, an angle defined by the pull cord and a transverse plane defined by a vertical and transverse direction of the shade assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shade assembly for an architectural opening, the shade assembly comprising:

a roller shade movable between a retracted position and an extended position, the roller shade defining a central plane when in the extended position that is oriented in a vertical direction and extends between opposed vertically extending sides of the roller shade; and a shade lock assembly operably connected to the roller shade, the shade lock, assembly comprising a spool defining a central axis about which the roller shade is wound and unwound to move the roller shade between the retracted and extended positions;

a housing defining a pull cord channel, the housing including a side wall and a locking surface spaced apart from the side wall;

a roller wheel moveable along the side wall of the housing within the pull cord channel between a locked position and an unlocked position;

a pull cord extending through the pull cord channel and being partially wrapped around the spool, the pull cord being movable relative to the roller shade in a transverse plane extending perpendicular to the central plane; and when the pull cord is moved away from the roller shade along the transverse plane to an angle that exceeds an angular threshold and the pull cord is unwound at least partially from the spool, the roller wheel is moved away from the locking surface along the side wall to the unlocked position to allow the pull cord to pass freely between the roller wheel and the locking surface.

2. The shade assembly of claim 1, wherein, when the pull cord is moved towards the roller shade along the transverse plane to a different angle that is less than the angular threshold and the pull cord is wound at least partially around the spool, the pull cord is configured to interact with the roller wheel such that the roller wheel is moved towards the locking surface along the side wall to the locked position.

3. The shade assembly of claim 1, wherein the locking surface is defined by a secondary wheel spaced apart from the side wall within the pull cord channel.

4. The shade assembly of claim 3, wherein the secondary wheel is attached to a pin defining a rotational axis, the pull cord contacting the secondary wheel such that the secondary wheel is rotated about the rotational axis as the pull cord is wound and unwound relative to the spool.

5. The shade assembly of claim 1, wherein the roller wheel defines a first plurality of ridges and wherein the side wall defines a second plurality of ridges, the first plurality of ridges of the roller wheel being configured to interact with the second plurality of ridges of the side wall as the roller wheel is moved between the locked and unlocked positions.

6. The shade assembly of claim 1, wherein the spool is located directly above the pull cord channel, the pull cord passing through the pull cord channel and extending vertically upwardly to the spool.

7. The shade assembly of claim 1, wherein the sidewall is oriented generally parallel to the central plane.

8. The shade assembly of claim 1, wherein the central plane extends between the opposed vertically extending sides in a horizontal direction that is perpendicular to the vertical direction, the central axis extending in the horizontal direction.

9. The shade assembly of claim 8, wherein the roller wheel is configured to rotate within the housing about a rotational axis, the rotational axis extending generally parallel to the central axis defined by the spool.

10. The shade assembly of claim 1, wherein the angular threshold corresponds to an angle defined within the transverse plane relative to the vertical direction that ranges from 15 degrees to 60 degrees.

11. The shade assembly of claim 2, wherein the pull cord is pinched between the roller wheel and the locking surface when the roller wheel is moved to the locked position.

12. The shade assembly of claim 2, wherein the interaction between the pull cord and the roller wheel results in rotation of the roller wheel about a rotational axis, the rotational axis being displaced in the vertical direction as the roller wheel is moved to the locked position.

13. The shade assembly of claim 12, wherein the roller wheel and the spool are rotated in a common rotational direction as the pull cord is wound around the spool and the roller wheel is moved to the locked position.

14. A shade lock assembly for a roller shade movable relative to an architectural opening between a retracted position and an extended position, the roller shade defining a central plane when in the extended position that is oriented in a vertical direction and extends between opposed vertically extending sides of the roller shade, the shade lock assembly comprising:

a spool defining a central axis about which the roller shade is configured to be wound and unwound to move the roller shade between the retracted and extended positions;

a housing defining a pull cord channel, the housing including a side wall and a locking surface spaced apart from the side wall;

a roller wheel moveable along the side well of the housing within the pull cord channel between a locked position and an unlocked position;

a pull cord extending through the pull cord channel and being partially wrapped around the spool, the pull cord configured to be movable in a transverse plane extending perpendicular to the central plane; and when the pull cord is moved in the transverse plane to an angle that exceeds an angular threshold and the pull cord is unwound at least partially from the spool, the roller wheel is moved away from the locking surface along the side wall to the unlocked position to allow the pull cord to pass freely between the roller wheel and the locking surface.

15. The shade lock assembly of claim 14, wherein, when the pull cord is moved in the transverse plane to a different angle that is less than the angular threshold and the pull cord is wound at least partially around the spool, the pull cord is configured to interact with the roller wheel such that the roller wheel is moved towards the locking surface along the side wall to the locked position.

16. The shade lock assembly of claim 15, wherein the pull cord is pinched between the roller wheel and the locking surface when the roller wheel is moved to the locked position.

17. The shade lock assembly of claim 15, wherein the interaction between the pull cord and the roller wheel results in rotation of the roller wheel about a rotational axis, the rotational axis being displaced in the vertical direction as the roller wheel is moved to the locked position.

18. The shade lock assembly of claim 17, wherein the roller wheel and the spool are rotated in a common rotational direction as the pull cord is wound around the spool and the roller wheel is moved to the locked position.

19. The shade lock assembly of claim 17, wherein the central axis of the spool and the rotational axis of the roller wheel extend in a direction that is generally parallel to the central plane.

20. The shade lock assembly of claim 14, wherein the spool is located directly above the pull cord channel, the pull cord passing through the pull cord channel and extending vertically upwardly to the spool.

* * * * *